United States Patent [19]

Vuilleumier

[11] Patent Number: 4,845,694

[45] Date of Patent: Jul. 4, 1989

[54] BATTERY CAP FOR A WATCH CASE

[75] Inventor: cyril Vuilleumier, Bienne, Switzerland

[73] Assignee: ETA SA Fabriques d'Ebauches, Granges, Switzerland

[21] Appl. No.: 133,469

[22] Filed: Dec. 15, 1987

[30] Foreign Application Priority Data

Dec. 17, 1986 [CH] Switzerland ..... 05030/86

[51] Int. Cl.[4] ..... G04B 37/00

[52] U.S. Cl. ..... 368/309; 368/310

[58] Field of Search ..... 368/294–296, 368/309, 281

[56] References Cited

U.S. PATENT DOCUMENTS

| | | | |
|---|---|---|---|
| 3,608,304 | 9/1971 | Schaad | 368/309 |
| 4,397,567 | 8/1983 | Stewart | 368/309 |
| 4,548,514 | 10/1985 | Ganter | 368/309 |

FOREIGN PATENT DOCUMENTS

| | | | |
|---|---|---|---|
| 912019 | 7/1946 | France . | |
| 26290 | 2/1983 | Japan | 368/309 |
| 52588 | 3/1983 | Japan | 368/309 |
| 205592 | 9/1939 | Switzerland . | |
| 319291 | 3/1957 | Switzerland . | |
| 374937 | 3/1964 | Switzerland . | |
| 1568475 | 5/1980 | United Kingdom . | |

*Primary Examiner*—Bernard Roskoski

*Attorney, Agent, or Firm*—Griffin, Branigan, & Butler

[57] ABSTRACT

The wrist watch case of this invention includes a caseband-back provided with supports for retaining a movement assembled from above the caseband. The caseband-back is provided with a circular opening having a diameter substantially greater than the diameter of a circle circumscribing the movement. The opening is blocked by a cap which is fixed to the caseband-back by fastening means arranged at the exterior of said circumscribing circle and at a level located above the lower face of the movement. The cap is provided with notches arranged and adapted to cooperate with a wrench supplied to the watch user thereby to open or close the cap and thus permit changing the battery. The wrench may form an integral part of the bracelet buckle.

6 Claims, 4 Drawing Sheets

BATTERY CAP FOR A WATCH CASE

This invention concerns a case for a wrist watch including a caseband-back formed integrally with an enlarging ring equipped with supports for retaining a movement assembled from above the caseband, said movement provided with hands for showing the time of day and being energized by a battery, a circular opening formed in the back of said caseband-back through which the battery may be put in place or removed, and a movable cap to block said opening mounted so as to be liquid-tight by means of a packing on said back.

BACKGROUND OF THE INVENTION

Here there should be made a clear distinction between a watch case including a caseband blocked by a back cover of large diameter where the back cover must be removed to have access to the battery, and a watch case including a caseband-back provided with a simple cover giving access to the battery.

The first of these arrangements is described for instance in the European Pat. No. EP-B-0 024 364 corresponding to U.S. Pat. No. 4,362,396. In this construction the movement is mounted from below the caseband, which itself is blocked by a screwed in back cover or by one which is pressed on. The back cover must be removed in order to proceed to the changing of the battery and this operation can only be accomplished by a person skilled in the art equipped with special tools and who at the same time will take care to retain the movement so that the latter does not fall out of the caseband. This arrangement provides the advantage of taking up very little space in the thickness of the watch since the back cover is attached to the caseband at a place situated above the lower face of the movement. However, as has just been noted, the battery is not accessible to anybody which may be considered as a disadvantage, above all at the present time, when certain inexpensive watches regularly offer this possibility.

The second arrangement is set forth for instance in the Japanese utility models JP Nos. 1 131 545 and 1 231 593. In these the watch case is provided with a caseband back, sometimes referred to as a monoshell case, wherein the movement is mounted from above the caseband. The cited documents show that the caseband is provided with an enlarging ring and supports for retaining the movement. There is provided in the cover of said caseband-back an opening just sufficient to enable the changing of the battery. This opening is blocked by a cap screwed into the back. This manner of proceeding provides the advantage of simplifying the assembly of the watch on automatic or transfer machines. Effectively all the loading operations take place from the same side, i.e. the top of the watch, and it is not necessary to turn over the timepiece in order to provide it with the various components. This second arrangement also provides the advantage of a back which takes up little space in the thickness. Furthermore, the battery cover may be removed by anybody and without requiring special tools. Generally, the cover provides a slot in which may be introduced a coin. The details of such a construction are shown in the British Pat. No. GB-A-1 408 610. It is immediately seen however that this cover takes up considerable space in thickness initially because of the place which must be provided for the slot receiving the coin and subsequently because of the thickness which must be provided for the screwthreads and the watertight packing. Finally, this method of proceeding is inelegant because of the outward projection of the cover.

To overcome the difficulties which have just been cited, the British Pat. No. GB-A-1 568 475 proposes to provide a cap of large diameter provided with a slot thanks to which the cap may be assembled for instance with the aid of a coin. In this document the groove is no longer situated under the battery, but beside the latter in a manner such that the thickness over the battery of the movement is not increased by the presence of this slot. However, the position of said slot is such that it requires a free space between the movement and the inside of the cap, such space finally resulting in an increase in the thickness of the watch in all cases where the thickness of the battery is included substantially in the thickness of the movement. It will be seen from the description of the present invention that no space is provided between the cap and the movement since the means of unscrewing the cap are situated outside the periphery of such movement, this enabling reduction to a minimum of the thickness of the watch.

To facilitate the construction as suggested in the description to follow, there will be preferably employed a bayonet-type lock, such type of lock being similar to that described in the Swiss Pat. No. CH-A-374 937 where the fastening means of the cap to the caseband are located at a level above the lower face of the movement. In this patent however, there is provided a watch case with a mechanical movement wherein the back cover must be removable, not for changing a battery, but in order to assemble or repair the movement and thus the access to the interior is not possible except to a person skilled in the art provided with special tools as has already been mentioned with reference to the first embodiment mentioned in the introduction to the present application and as has been described in the cited patent wherein the utilization of a press is mentioned. Furthermore, in this patent, the wish to provide a watch of small thickness is not apparent since considerable space remains between the back cover and the movement.

SUMMARY OF THE INVENTION

The present invention proposes to eliminate the difficulties listed hereinabove by providing a case for a wrist watch including a caseband-back integrally formed with an enlarging ring equipped with supports for retaining a movement assembled from above the caseband said movement provided with hands for showing the time of day and being energized by a battery, a circular opening formed in the back of said caseband-back through which the battery may be put in place or removed and a movable cap to block said opening mounted to be liquid tight by means of a packing on said back, the opening being coaxial with the axis of the hands and having a diameter which is substantially greater than the diameter of a circle circumscribing the movement, the cap being fixed to the caseband-back by fastening means arranged at the exterior of said circumscribing circle and at a level above that of the lower face of the movement, said cap furthermore bearing on its outer side means capable of being operated by the watch user to open or close said cap, said means capable of being operated by the watch user being arranged outside said circumscribing circle.

The invention will be better understood following reading of the description to follow, such description being illustrated by way of example by the drawings.

DESCRIPTION OF THE PREFERRED EMBODIMENTS

Figure 1:
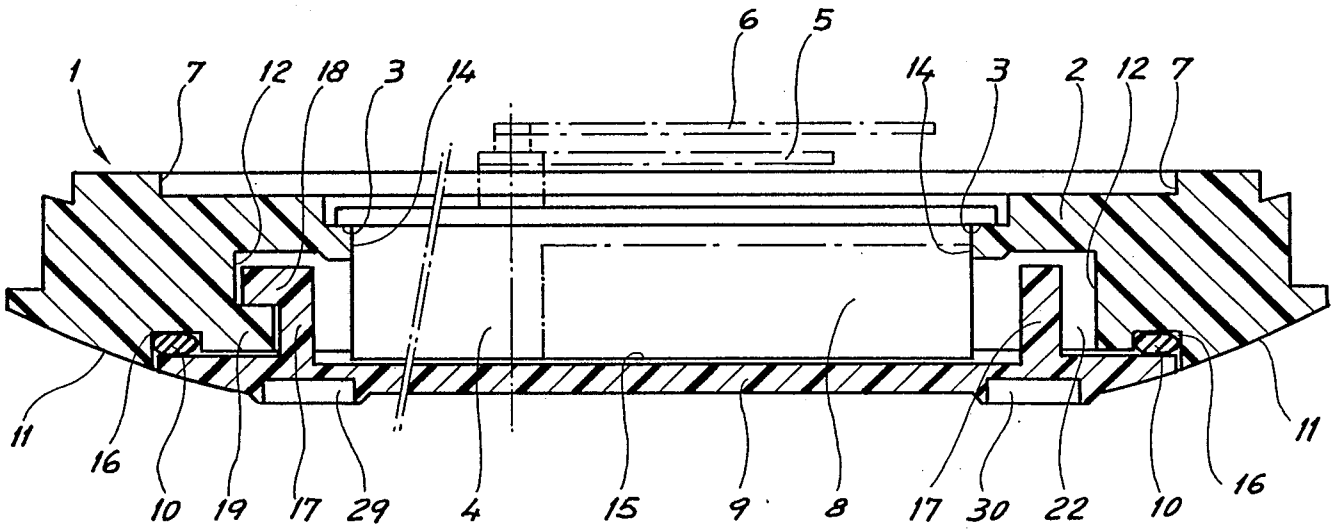
FIG. 1 is a cross-section from 6 o'clock to 12 o'clock of the caseband-back, arranged in accordance with a first embodiment, of the invention, said casebandback being equipped with its cap and its movement.

As may be seen on FIG. 1, the watch case includes a caseband-back 1 integrally formed with an enlarging ring 2 equipped with support 3 for retaining a movement 4. The movement drives hours hand 5 and minutes hand 6 sketched here in dot-and-dashed lines. These hands surmount a dial which is not shown and which is housed in the opening bounded by wall 7. On caseband-back 1 is mounted a bezel provided with a crystal according to procedures known in the state of the art. Dial, flange, bezel and crystal have not been shown here since they are not concerned with the present invention. The movement 4 which generally includes a stepping motor controlled by a quartz is energized by a battery 8 which is indicated by dot-and-dashed lines on FIG. 1.

As has already been recalled hereinabove, a case of the type which has just been described with assembly of the movement from above may include a back formed integrally with the caseband. In the back is provided an opening to enable changing of the battery, such opening being closed by a cap. This is what is to be found in the construction shown on FIG. 1 where removal of the cap referenced 9 gives direct access to the battery 8. In contrast, however, with what is found in the prior art, cap 9 of the present invention covers the movement 4 entirely instead of covering only the battery contained in the movement.

As may be seen on FIG. 1, the removable cap 9 is mounted in a water-tight fashion on the caseband-back 1 by use of a packing 10, this latter being squeezed between the cap 9 and a groove 16 provided in the back 11 of the caseband-back 1 when the cap is in place.

Figure 2:
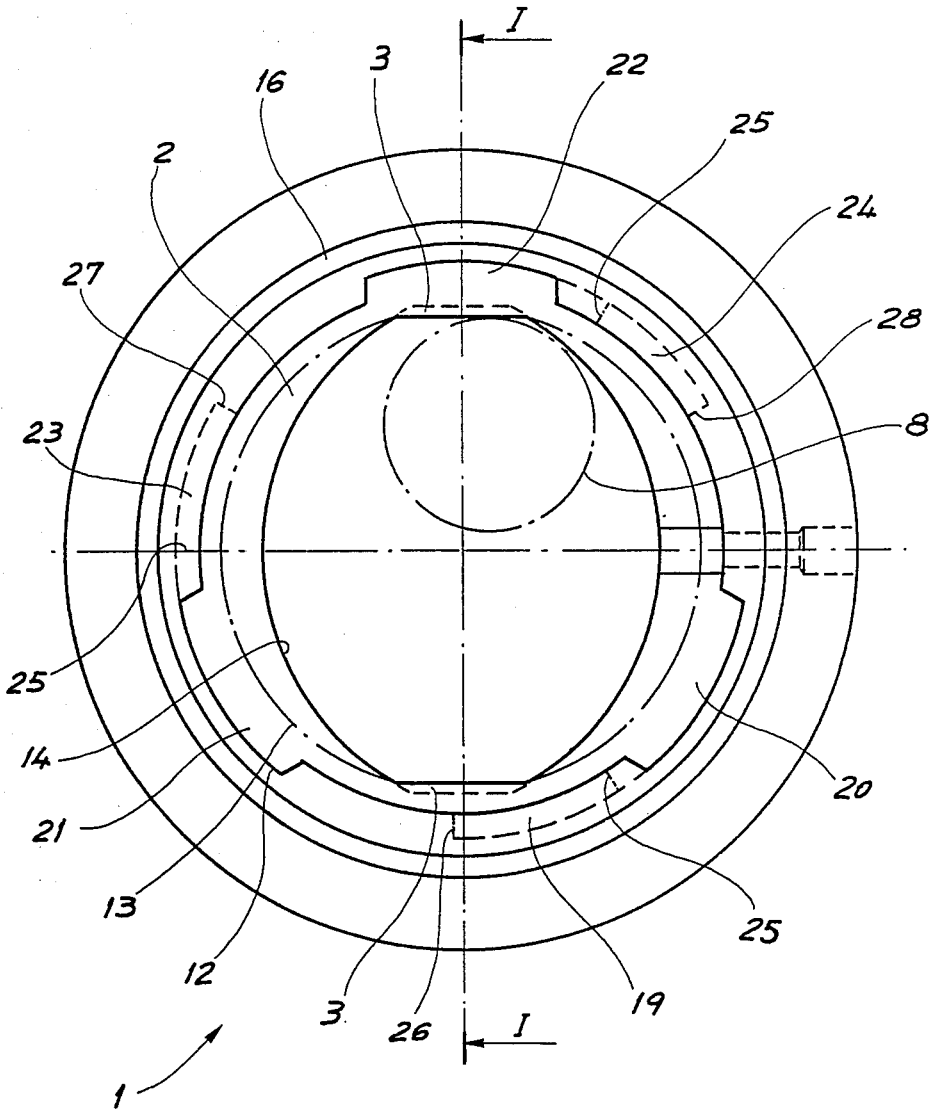
FIG. 2 is a view from below of the caseband-back shown without cap or movement.

Referring now as well to FIG. 2 which is a view from below of the caseband-back drawn at a scale reduced by half relative to the scale employed for FIG. 1, one will see that the opening 12 provided in the caseband-back 1 is circular, that this opening is co-axial with the axis of hands 5 and 6 and exhibits a diameter substantially greater than the diameter of the circle 13 circumscribing movement 8, the circle 13 being shown in dot-and-dashed lines on FIG. 2. FIG. 2 likewise shows the enlarging ring 2 provided with supports 3 against which will abut the movement (which is not shown here, but which is suggested by the contour 14 of the opening in which it penetrates) and battery 8 sketched in dot-and-dashed lines. Here one is concerned with a barrel-type movement which explains the oblong form of the opening 14. One could likewise have a round movement in which case the opening 14 merges with the circumscribing circle 13.

Cap 9 is fastened to the caseband-back by fastening means located outside the circumscribing circle 13 and at a level situated above the lower face 15 of movement 4. These fastening means which envelop thus the movement at its periphery bring the fastening of the cap within the thickness of the caseband and no longer within the thickness of the back as has been provided in prior art discussed hereinabove from whence the saving of space which is manifested in the overall thickness of the watch.

These fastening means may consist in a threading forming part of the cap and raised relative to its inside surface, such threading being adapted to cooperate with threads provided in the wall of opening 12. Here, however, there has been preferred bayonet fastening means which are easier to build in. To this effect cap 9 bears a stiffening ring 17 integrally formed therewith, this ring including at least two elbowed wings 18 cooperating with the same number of latching edges 19 provided in the caseband-back 1. FIG. 2 shows a caseband-back 1 provided with three curved openings 20, 21 and 22 and three latching edges 19, 23 and 24. Each of these latching edges provides an opening of gradual inclination followed by a flattened portion, the passage from one plane to the other being shown by the dotted line 25. Thus, when it is required to latch the cap 9 onto the caseband-back 1, there is introduced into the curved openings 20, 21 and 22 the respective wings 18 of cap 19, the cap is turned in the clockwise sense while compressing the packing 10 in its housing 16. Wings 18 then engage on the latching edges respectively referenced 19, 23 and 24 until they abut against the edges respectively referenced 26, 27 and 28.

In referring again to FIG. 1, it is seen that wing 18 cooperates with edge 19 at a level situated within the thickness of movement 4. The same may be said of the packing 10 situated itself above the lower face 15 of the movement. These methods of construction thus contribute greatly to minimizing the thickness of the case. When the cap is removed, it will be observed that the movement remains in place and that one may easily change battery 8 contained in the movement. This battery is provided with the usual contact clamps and may or may not be retained within its housing. If it is not retained by the housing it will be by the cap once the latter has been put into place. The fact that removal of the cap uncovers the entire movement may be to the advantage of the watchmaker who has access then to the screw of the trigger piece, this permitting easy removal of the control stem. Finally, it is to be noted that in a preferred solution the casebandback and the cap are formed of plastic material, nothing however preventing forming them of metal for instance.

According to the invention the cap furthermore bears means capable of being operated by the watch user to open and close said cap. According to a first embodiment shown on FIG. 1, such means consist of two notches 29 and 30 provided on the outside of cap 9.

These notches may be cylindrical or of any form and are arranged along a common diameter. FIG. 1 likewise shows that the notches 29 and 30 are located opposite the fastening means borne on the inside of the cap or, if preferred, facing the stiffening ring 17 and this for evident reasons of strength and good workmanship of the cap. Into these notches may be engaged the ends of the branches of a wrench in the form of a U (not shown on the drawing) and provided when the watch is purchased.

Figure 3:
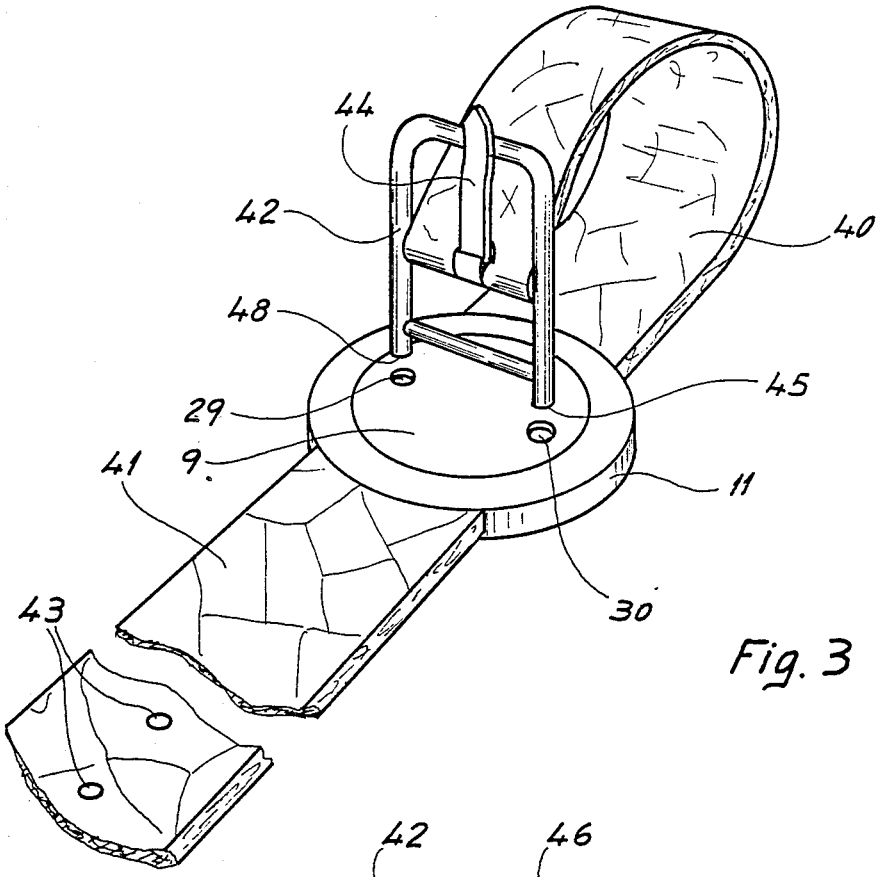
FIG. 3 is a perspective drawing of the first embodiment wherein the watch is equipped with its bracelet, the buckle of which provides a wrench enabling removal of the cap.

The wrench in the form of a U which has just been suggested may be lost by the watch user. It is for this reason, according to another proposal of the invention, that one will prefer to integrate such wrench with the bracelet buckle. FIG. 3 shows such an arrangement. In this figure the watch case, the back 11 of which is shown with the cap 9 assembled is equipped with a bracelet shown by strands 40 and 41. Strand 40 includes a buckle 42 provided with a tongue 44 which cooperates with one of the holes 43 of the strand 41. It is seen that each branch of buckle 42 possesses a projection 45, 48 intended to cooperate with a notch 29, 30 provided in the cap 9. In the particular case of FIG. 3, the projections 45, 48 are located in the extension of the branches of buckle 42.

Figure 4:
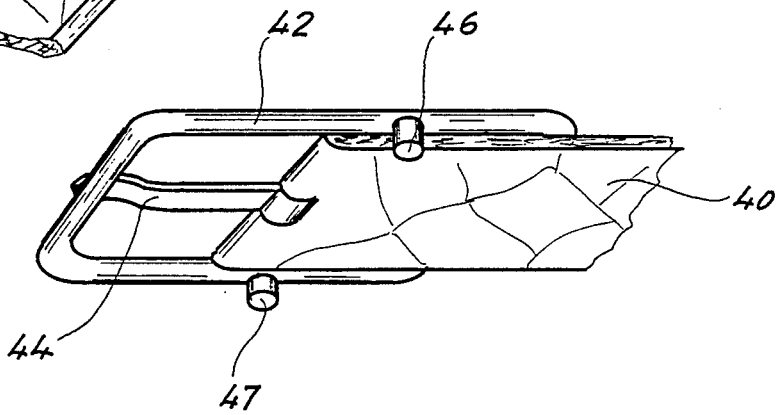
FIG. 4 is another embodiment of the wrench which forms an integral part of the bracelet buckle.

FIG. 4 shows another form of the wrench which likewise forms an integral part of the bracelet buckle. In this case the projections are no longer situated in the extension of the buckle branches but are rather perpendicular to said branches and in the form of nipples referenced 46 and 47.

It will be noted that the solutions shown on FIGS. 3 and 4 require to some degree to have available a cap 9 of large diameter. Effectively, the caps of the prior art provide a diameter which is too small and the notches 29 and 30 could no longer be sufficiently spaced apart to receive the projections of a buckle of normal dimensions.

Figure 5:
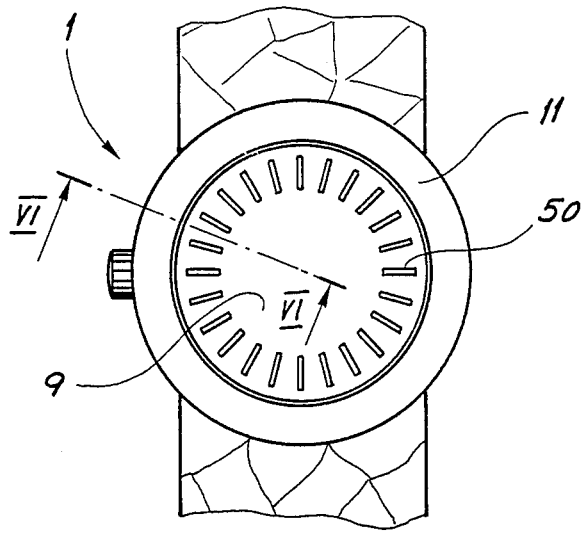
FIG. 5 is a plan view of a second embodiment of the invention, the watch being seen from below.
Figure 6A:
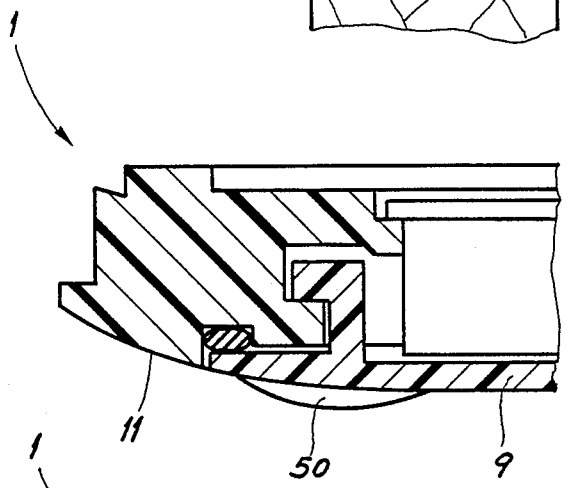
FIG. 6*a* is a cross-section along line VI—VI of FIG. 5 and shows a first variant of the second embodiment.
Figure 6B:
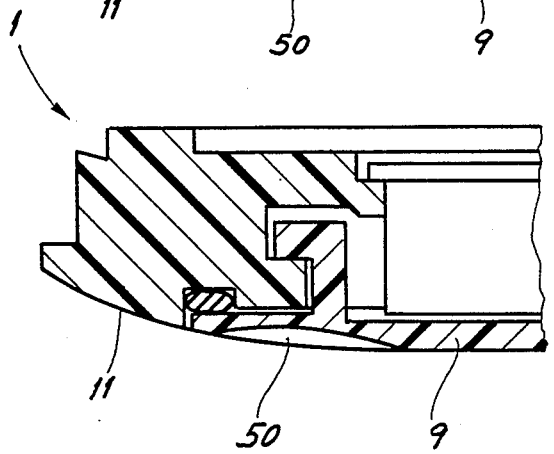
FIG. 6*b* is a cross-section according to line VI—VI of FIG. 5 and shows a second variant of the second embodiment.

FIGS. 5, 6*a* and 6*b* provide a second embodiment of the invention. Here the cap 9 assembled in back 11 is not provided with the notches 29 and 30 which characterize the first embodiment. Cap 9 bears striations 50 radially arranged on the outside of said cap and within the periphery of this latter. These striations may be provided as projections (FIG. 6*a*) or as hollows (FIG. 6*b*) on the cap, and enable the assembly or removal of said cap simply with the fingers. In such embodiment a wrench is thus no longer necessary.

What I claim is:

1. A case for a wrist watch including a bracelet of flexible material and a pivoting buckle at the end of one of the bracelet strands, said buckle having two projections, each projection being borne by a branch of the buckle the case including a caseband-back integrally formed with an enlarging ring equipped with supports for retaining a movement assembled from above the caseband said movement being with hands for showing the time of day and being energized by a battery, a circular opening formed in the back of said caseband-back through which the battery may be put in place or removed and a circular movable cap to block said circular opening mounted to be liquid tight by means of a packing on said back, the circular opening being coaxial with the axis of the hands and having a diameter which is substantially greater than the diameter of a circle circumscribing the movement, the cap being fixed to the casebandback by fastening means arranged at the exterior of said circumscribing circle and at a level above that of the lower face of the movement, said cap bearing on its outer side two diametrally opposite notches in each of which may be engaged a projection borne on each branch of the buckle said buckle thus serving as wrench to open or close the cap by imparting a rotational motion to said cap.

2. A watch case as set forth in claim 1 wherein said fastening means consist of a bayonet lock, the cap comprising at least two elbowed wings borne by a stiffening ring, said wings cooperating with an equal number of latching edges provided in the caseband-back.

3. A watch case as set forth in claim 1 wherein the cap and the caseband-back are formed from plastic material.

4. A watch case as set forth in claim 2 wherein the notches arranged on the outside of the cap are located opposite the stiffening ring borne on the inside of said cap.

5. A watch case as set forth in claim 1 wherein the projections are provided as an extension of the buckle branches.

6. A watch case as set forth in claim 1 wherein the projections take the form of nipples arranged perpendicularly to the buckle branches.

* * * * *